US008689492B2

(12) United States Patent
Desotell et al.

(10) Patent No.: US 8,689,492 B2
(45) Date of Patent: Apr. 8, 2014

(54) MOTORIZED ROTATING GUTTER

(71) Applicant: RRTK Enterprises, Inc., Green Bay, WI (US)

(72) Inventors: Ronald J. Desotell, Green Bay, WI (US); Gerald D. Leisgang, Green Bay, WI (US); William D. Leisgang, Green Bay, WI (US)

(73) Assignee: RRTK Enterprise, Inc., Green Bay, WI (US)

( * ) Notice: Subject to any disclaimer, the term of this patent is extended or adjusted under 35 U.S.C. 154(b) by 0 days.

(21) Appl. No.: 13/681,558

(22) Filed: Nov. 20, 2012

(65) Prior Publication Data

US 2013/0074423 A1 Mar. 28, 2013

Related U.S. Application Data

(62) Division of application No. 12/062,172, filed on Apr. 3, 2008, now Pat. No. 8,322,081.

(51) Int. Cl.
*E04D 13/00* (2006.01)

(52) U.S. Cl.
USPC ..... 52/11; 248/48.1; 248/48.2

(58) Field of Classification Search
USPC ..... 52/11; 248/48.1, 48.2
See application file for complete search history.

(56) References Cited

U.S. PATENT DOCUMENTS

| | | | | |
|---|---|---|---|---|
| 510,515 | A | 12/1893 | McKenney | |
| 4,072,285 | A | 2/1978 | Greenwood | |
| 4,117,635 | A * | 10/1978 | Nelson | 52/11 |
| 4,309,792 | A | 1/1982 | Faye | |
| 4,311,292 | A | 1/1982 | Deason | |
| 4,413,449 | A * | 11/1983 | Faye | 52/16 |
| 4,669,232 | A | 6/1987 | Wyatt | |
| 4,696,131 | A | 9/1987 | Schreffler | |
| 4,709,516 | A | 12/1987 | Gleaves | |
| 4,837,987 | A * | 6/1989 | Fender | 52/11 |
| 5,274,965 | A | 1/1994 | Jackson | |
| 5,335,460 | A * | 8/1994 | Smith, Jr. | 52/11 |
| 5,357,719 | A * | 10/1994 | Lewis | 52/11 |
| 5,649,681 | A | 7/1997 | Faye | |
| 6,233,876 | B1 * | 5/2001 | Obidniak | 52/16 |
| 6,240,679 | B1 * | 6/2001 | Smalara | 52/16 |
| 6,854,692 | B1 | 2/2005 | Winkel | |
| 7,152,376 | B2 | 12/2006 | Wyatt | |
| 8,141,302 | B2 * | 3/2012 | Desotell et al. | 52/11 |
| 8,215,080 | B2 * | 7/2012 | McNeish et al. | 52/741.1 |
| 8,322,081 | B2 * | 12/2012 | Desotell et al. | 52/11 |
| 2003/0033756 | A1 * | 2/2003 | Adams et al. | 52/11 |
| 2009/0183438 | A1 * | 7/2009 | Walker | 52/11 |

OTHER PUBLICATIONS

Flip It—Gutter Cleaning System, available at: http://www.flipitindustries.com.au/index.php?option=com_content&task=view&id=18&Itemid=53, Available Feb. 2008.

Flip Clean Gutter System, available at: http:flipgutters.com/, http://flipcleanguttersystems.com/, and http://www.flipgutters.com/about1.html, Available Sep. 2008.

* cited by examiner

*Primary Examiner* — Andrew Triggs
(74) *Attorney, Agent, or Firm* — Boyle Fredrickson, S.C.

(57) ABSTRACT

A roof-mounted actuator of a gutter dumping assembly is actuatable to rotate a gutter from an initial, upright position to a downwardly-facing dumped position in order to dump debris from the gutter. The actuator is coupled to the gutter support by a flexible structure so that, after the actuator positively engages a support for the gutter and forces it to an over-center position, the gutter falls to a dumped position under only the force of gravity.

15 Claims, 6 Drawing Sheets

MOTORIZED ROTATING GUTTER

CROSS REFERENCE TO RELATED APPLICATIONS

This application is a divisional of co-pending and commonly assigned U.S. patent application Ser. No. 12/062,172, filed Apr. 3, 2008, and entitled "Motorized Rotating Gutter", the contents of which are hereby incorporated by reference in its entirety.

BACKGROUND OF THE INVENTION

1. Field of the Invention

The invention generally relates to gutters and gutter assemblies for houses and commercial buildings. More particularly, the invention relates to a motorized gutter dumping assembly configured to rotate a gutter from an initial upright position to a dumped position to clear the gutter of collected debris such as leaves, debris, mud and the like.

2. Discussion of the Related Art

Gutter systems for use with dwellings or other such buildings are used to channel water flowing off of a roof Such systems generally comprise horizontal gutters for receiving the water, brackets for securing the gutters to the dwelling, and a downspout for channeling collected water from the gutters to a drainage system leading away from the dwelling to a storm sewer or other discharge area.

Over the course of time, such gutters commonly become obstructed by the accumulation of debris such as leaves, twigs, snow, ice, and the like. Unless such debris is periodically removed, water that is normally easily drained by way of the downspout will either overflow or be prevented from flowing into the gutter. In either case, the water will often flow down the side of the dwelling and cause significant structural damage and the collection and growth of mildew. Further, water which is prevented from flowing down the roof and into the gutter will often accumulate on the roof and leak therethrough, causing damage to the inside of the dwelling.

Gutters may be manually cleaned by climbing onto the roof of the dwelling and removing accumulated debris by hand or by use of a hose or a manual tool such as a rake. However, this method is quite time consuming, strenuous, and potentially dangerous.

Accordingly, a number of methods of preventing the collection of debris or removing collected debris are known. For example, a commonly used method for preventing the build up of debris utilizes a screen or guard designed to overlie the opening of the gutter. However, while such systems prevent the collection of debris in the gutters, they tend to clog and make the cleaning of the gutter substantially more difficult.

In order to overcome the various disadvantages associated with the aforementioned methods of preventing debris collection or removing collected debris, rotatable gutter systems have been designed to aid in the removal of collected debris. Such systems typically rotate the gutter from an initial, upright position, to a downwardly-facing, dumped position to cause any collected debris to fall to the ground under the force of gravity or to allow for easier access to the gutter such that the debris may be more easily cleaned out by hand or with a tool such as a hose or rake. Typically, however, such gutter systems require custom-built gutter assemblies or relatively complicated pivoting mechanisms. The systems are dumped by complex and relatively unreliable chain driven arrangement. Such systems are typically quite conspicuous and therefore detract from the appearance of the dwelling. In addition, such systems generally cannot be used on relatively flat roofs.

The need therefore exists to provide gutter dumping assembly that is relatively simple to maintain and is robust enough to withstand the rigors associated with operation of such systems. The need also exists for a gutter dumping assembly that can be quickly and efficiently assembled and maintained. Further, the need also exists for a gutter dumping assembly that may be installed on existing gutters.

SUMMARY OF THE INVENTION

In accordance with a first aspect of the invention, at least one of the above-identified needs is met by providing a gutter dumping assembly having a relatively simple design and configured to be used with existing gutters. The gutter may be selectively rotated from an initial, upright position to a downwardly-facing dumped position by driving a simple roof-mounted actuator system to engage a bracket assembly configured to receive and retain a portion of the gutter. Similarly, the gutter dumping assembly may selectively rotate the gutter back to its upright position after the contents have been dumped or otherwise cleaned out.

In one embodiment, the gutter dumping assembly includes a bracket assembly mounted to a dwelling and configured to receive and retain a gutter. An actuator assembly is mounted to the dwelling and is configured to operably engage the bracket assembly to cause the rotation of the bracket assembly as well as the gutter. The driving of the actuator assembly to engage the bracket assembly results in the bracket assembly and the gutter being rotated from an initial upright position to an over-center position at which point the gutter falls to a dumped position under only the force of gravity. If desired, for longer gutter sections, more than one actuator assembly may be employed. In such assemblies, a support member may be provided to link the bracket assemblies to one another for simultaneous rotation thereof.

In one embodiment, the bracket assembly comprises a first bracket rigidly mounted to the dwelling and a second bracket hingedly mounted to the first bracket. The second bracket is configured to be operably engaged by the actuator assembly to cause rotation of the bracket assembly and gutter. Further, the second bracket may comprise a lower leg coupled to a downwardly-angled upper leg. The upper leg further includes a retainer configured to receive and retain a flange of the gutter therebetween.

In one embodiment, the actuator assembly comprises a base coupled to a telescopically extendible strap. The strap is coupled to a kicker bracket configured to be engaged by the actuator upon driving of the actuator assembly and coupled to the second bracket of the bracket assembly. As such, the engagement and rotation of the kicker bracket by the actuator causes the second bracket and gutter to be rotated into the dumped position.

The base of the actuator assembly may, if desired, comprise an outer tube and an inner tube telescopically extendible therefrom. Accordingly, the strap is coupled to the inner tube of the base for extension therefrom.

Another aspect of a preferred embodiment of the present invention includes providing a kicker bracket having substantially vertical leg and a forwardly extending horizontal leg coupled to the vertical leg. The vertical leg acts as an abutment surface for engagement with the inner tube of the actuator assembly. Further, the kicker bracket may include a rearwardly extending horizontal leg coupled to the vertical leg configured to prevent the actuator assembly from pivoting upwardly and out of contact with the kicker bracket during driving of the actuator assembly.

In yet another aspect of the present invention, a method of rotating a gutter from an upright position to a downwardly facing position to allow for dumping or otherwise cleaning out the gutter includes driving a roof-mounted actuator assembly so as to operably engage a bracket assembly configured to retain the gutter thereby rotating the bracket and gutter to a over-center position. Once reaching the over-center position, the bracket assembly and gutter may freely fall to a downwardly facing position under the force of gravity. Accordingly, the contents of the gutter are dumped or otherwise easily manually removed therefrom. The gutter dumping assembly may likewise rotate the gutter back to its initial upright position.

Various other features, embodiments and alternatives of the present invention will be made apparent from the following detailed description taken together with the drawings. It should be understood, however, that the detailed description and specific examples, while indicating preferred embodiments of the invention, are given by way of illustration and not limitation. Many changes and modifications could be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings, in which like reference numerals represent like parts throughout, and in which.

DETAILED DESCRIPTION OF THE PREFERRED EMBODIMENTS

A gutter dumping assembly constructed in accordance with a preferred embodiment of the invention is described below in connection with a standard gutter assembly for a dwelling. It should be understood that the illustrated assembly and others constructed in accordance with the invention could be used with other such gutter systems for buildings including those with substantially flat roofs. In addition, the gutter dumping assembly constructed in accordance with this invention could be used with custom-made gutters.

Figure 1:
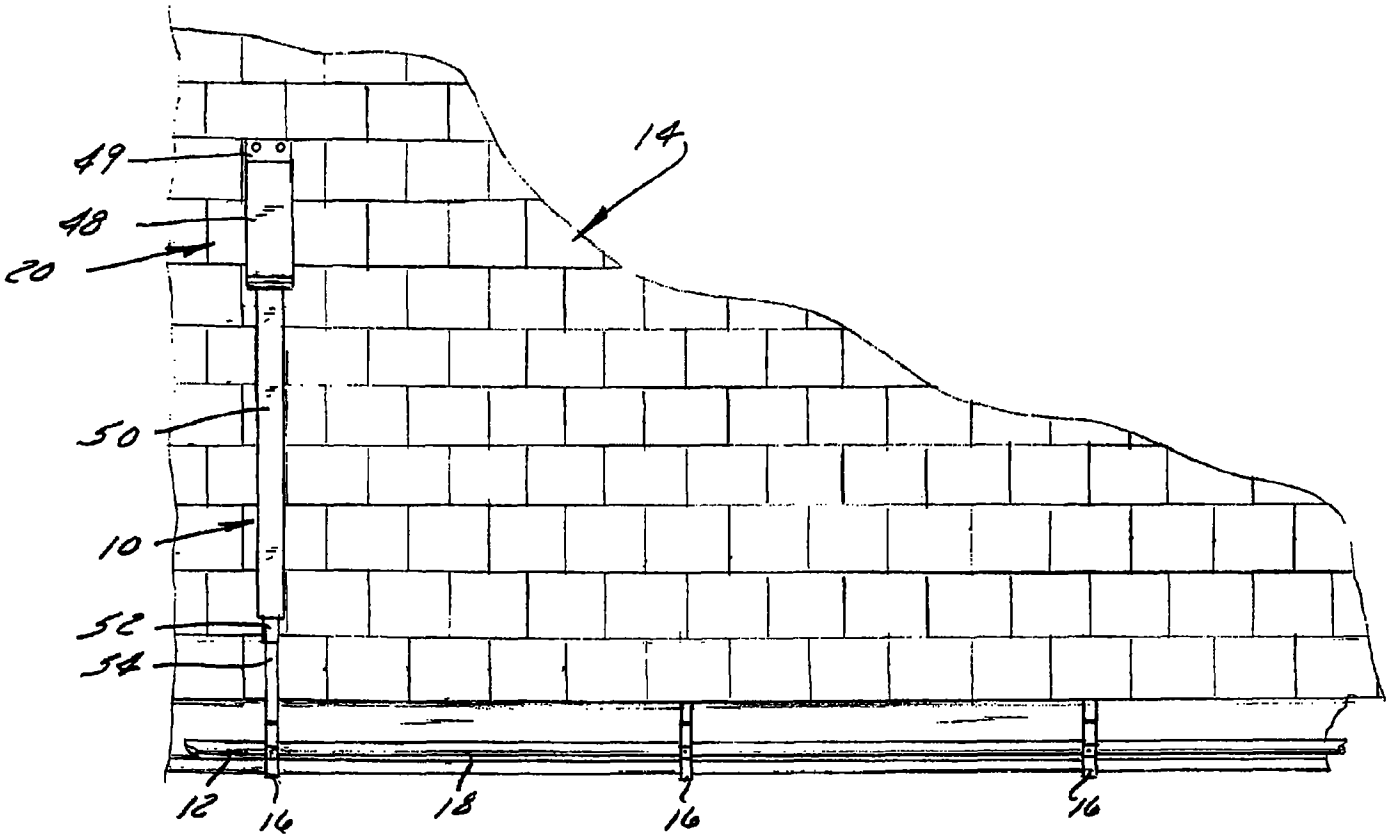
FIG. 1 is a top plan view of a gutter equipped with a gutter dumping assembly according to a preferred embodiment of the present invention.
Figure 2:
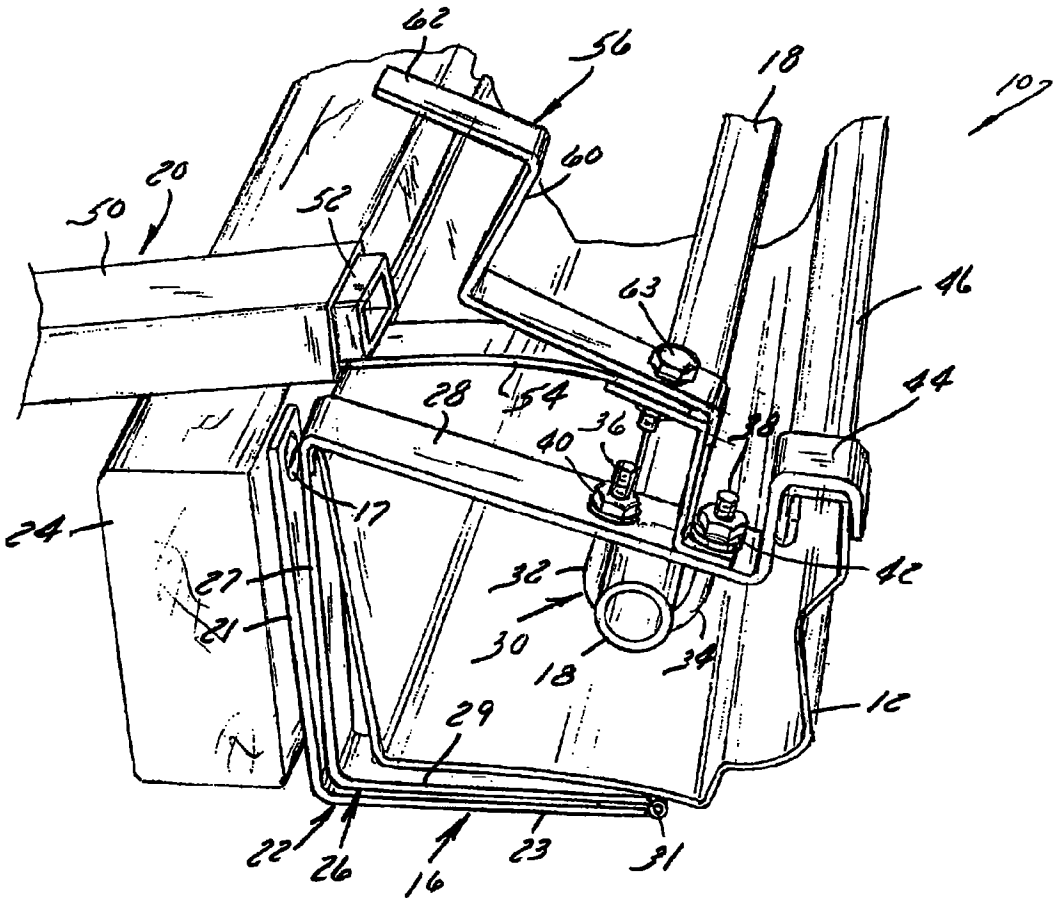
FIG. 2 is a perspective view of a portion of the gutter dumping assembly of FIG. 1.

Referring initially to FIGS. 1 and 2, a gutter dumping assembly 10 for selectively dumping a standard gutter 12 and returning the gutter 12 to its initial position is coupled to a gutter 12 on the roof 14 of a dwelling. The gutter dumping assembly 10 includes a plurality of spaced bracket assemblies 16 that support a rigid support tube 18. The gutter dumping assembly 10 also includes at least one roof-mounted actuator assembly 20. The bracket assemblies 16 are set at a spacing of twenty feet in this embodiment, but considerably smaller or larger spacings are envisioned. Preferably, one gutter dumping assembly 10 is required for each 20-foot section of gutter 12. As such, the gutter dumping assembly 10 of the present invention may comprise a plurality of rigid support tubes 18 and a corresponding number of actuator assemblies 20 for gutters 12 that are longer than twenty feet.

Figure 4:
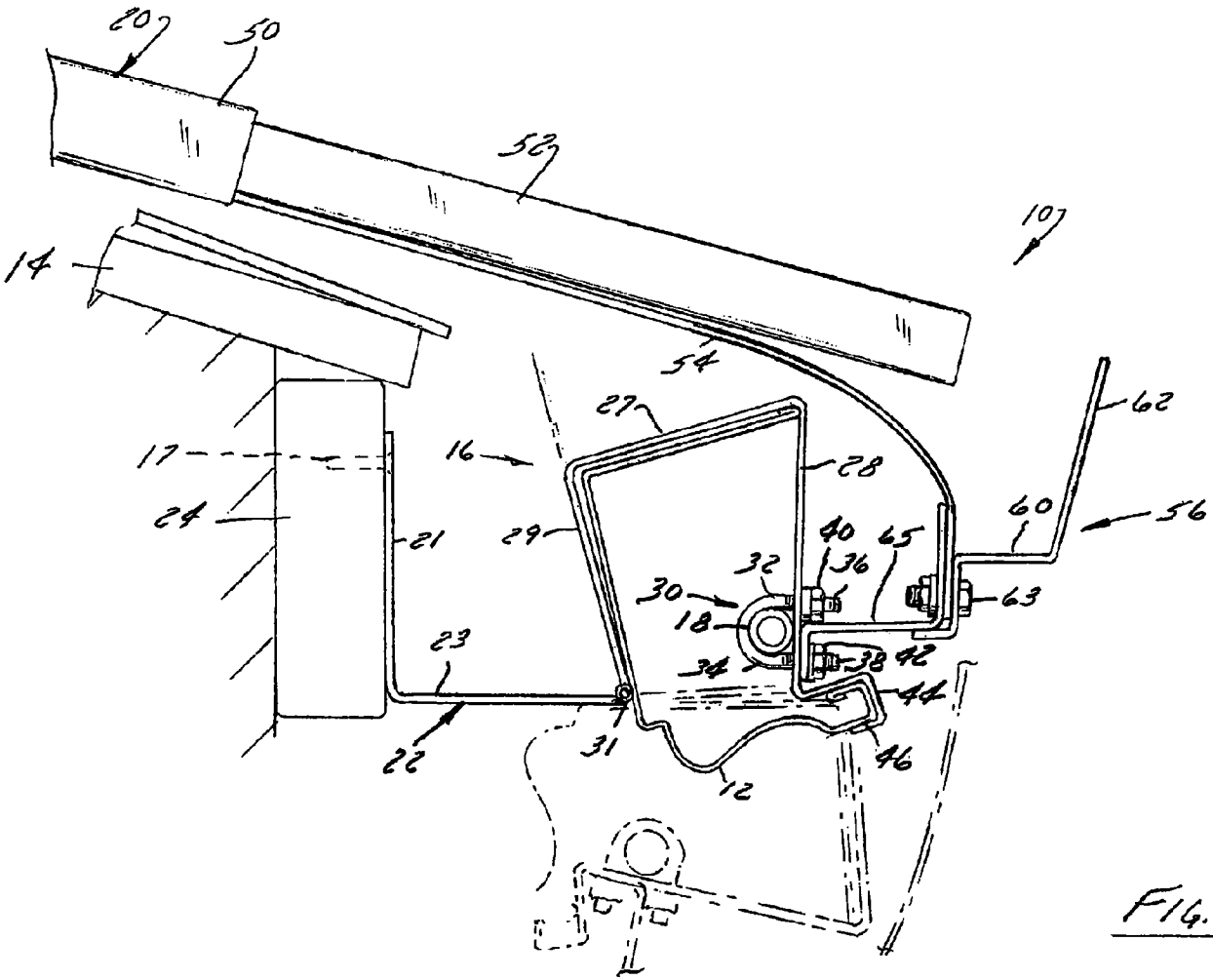
FIG. 4 is an end elevation view of the gutter dumping assembly of FIGS. 1-3B, showing the rotation of the gutter dumping assembly rotated from its initial upright position and a downwardly facing dumped position in shadow.

Referring to FIG. 4, each bracket assembly 16 preferably comprises an L-bracket 22 rigidly mounted to a fascia 24 or similar structure on the roof 14 by way of one or more fastener 17 such as a bolt or screw. A C-bracket 26 is hingedly coupled to L-bracket 22 and configured to be movable from a first position wherein the C-bracket pulls the gutter 12 upright to a dumped position on which the C-bracket 26 swings downwardly as much as 180 degrees. The C-bracket 26 includes an upper leg 28 that is preferably angled downwardly such that the rigid support tube 18 is hidden in gutter 12. Upper leg 28 of C-bracket 26 also serves to prevent water from running off the front or back of the gutter. It additionally includes a central leg 27 and a lower leg 29. The central leg 27 is generally flush with a vertical leg 21 of the L-bracket 22 when the C-bracket 26 is in its normal upright position illustrated in FIG. 1. The lower leg 29 extends beneath the bottom surface of the gutter 12 and extends horizontally so as to be generally flush with a horizontal leg 23 of the L-bracket 22 when the C-bracket is in its normal upright position illustrated in FIG. 1. The outer end of the lower leg 29 is pivotally attached the outer end of the horizontal leg 23 of the L-Bracket 22 by a hinge 31.

Still referring to FIG. 4, upper leg 28 of C-bracket 26 further includes a fastener 30 coupled thereto for retaining a portion of support tube 18. Fastener 30 may comprise a U-shape having two ends 32 and 34 configured to be received by holes in upper leg 28. Preferably, each of ends 32 and 34 includes a threaded portion, 36 and 38 respectively, for receiving nuts 40 and 42 thereon. Nuts 40 and 42 are provided to secure U-bolt 30 such that support tube 18 is securely retained therein. Upper leg 28 further comprises a retainer 44 for receiving an upper flange 46 of gutter 12. Preferably, upper flange 46 of gutter 12 simply snaps in under retainer 44 for securing gutter 12 therein.

Figure 7:
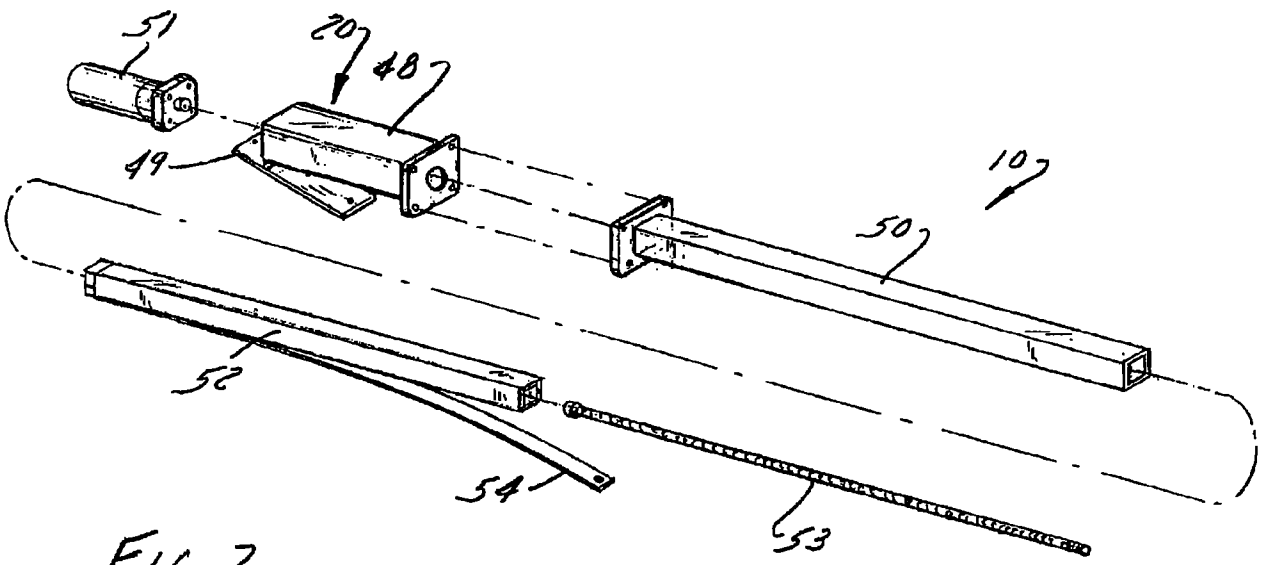
FIG. 7 is a partially exploded perspective view of the actuator assembly of the gutter dumping assembly of FIGS. 1-5.

Referring now to FIGS. 1, 2 and 7, actuator assembly 20 is configured to selectively dump the gutter 12 by driving the C-brackets 26 to pivot about their hinges 31. Unlike prior actuators that were mounted beneath the level of the roof and that were coupled to the gutters by complex chain drives, the actuator assembly 20 is preferably mounted on the roof 14 so as to be inconspicuous and is coupled to one or more of the brackets in a simple, robust, and flexible manner. Actuator assembly 20 is preferably linearly extendible rather than having a rotary output. In the illustrated embodiment, it preferably comprises an electric actuator, more preferably a screw jack mounted on the roof 14 of the dwelling and is configured to operably engage one or more of C-brackets 26. Preferably, actuator assembly 20 includes a base 48, a stationary outer tube 50 and an inner tube 52 telescopically housed within outer tube 50. The inner tube 52 is telescopically extendible from outer tube 50 during operation of the actuator assembly 20. The base 48 is mounted to the roof 14 of the dwelling screws or the like extending through a bracket 49 or similar such fastener. The outer tube 50 is hinged or otherwise pivotally attached to the bracket 49 so that the actuator assembly 20 can pivot as the inner tube 52 extends. This permits the outer end of the tube 52 to follow the motion of the kicker bracket, described in more detail below.

Referring to FIGS. 1 and 7, actuator assembly 20 additionally includes a motor 51 configured to drive the actuator assembly 20. Preferably, actuator assembly 20 comprises a screw jack 53 housed in the inner tube 52. Screw jack 53 is preferably in communication with motor 51 such that motor 51 drives screw jack 53 to effectuate the telescopic movement of inner tube 52 from outer tube 50. Being mounted on to of the roof at a location that is spaced inwardly from an outer edge of the roof, the motor 51 necessarily is located vertically above the roof inwardly of an outer edge of the roof.

Actuator assembly 20 is coupled to the bracket 16 by a flexible strap 54 fixed to the bottom of the inner tube 52 and coupled to a kicker bracket 56 by way of a bolt 63 or other such fastener. Kicker bracket 56 is bolted or otherwise fastened to upper leg 28 of C-bracket 26. Preferably, kicker bracket 56 is coupled to one of ends 36 and 38 of U-bolt 30 by way of a coupling bracket 65 disposed between the kicker bracket 56 and C-bracket 26 and retained by a nut 58 or similar such fastener. Kicker bracket 56 includes a vertical leg 60 and a generally forwardly extending horizontal leg 62 at an inward end of vertical leg 60. Vertical leg 60 serves as an abutment surface for engagement with inner tube 52 of actuator assembly 20. The forwardly extending horizontal leg 62 acts as a stop to prevent the inner tube 52 from pivoting upwardly and out of contact with the kicker bracket 56 upon actuation thereof. This permits the actuator assembly 20 to be used with widely varying roof pitches. In addition, a cover may be provided for the actuator assembly 20 so as to make the assembly more aesthetically pleasing.

Figure 3A:
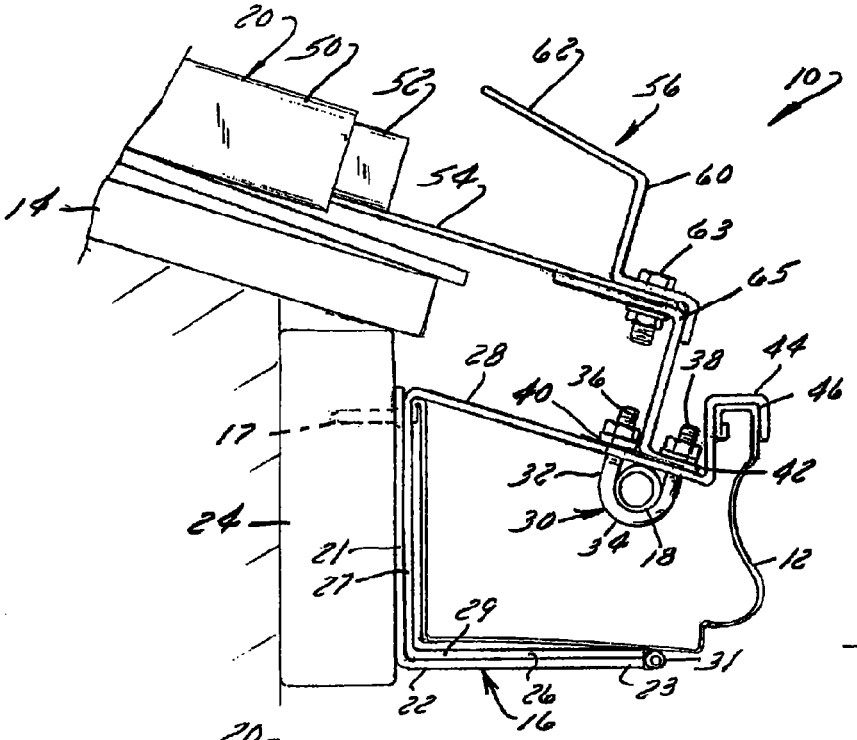
FIG. 3A is an end elevation view of the gutter dumping assembly of FIGS. 1 and 2 in an initial upright position.
Figure 3B:
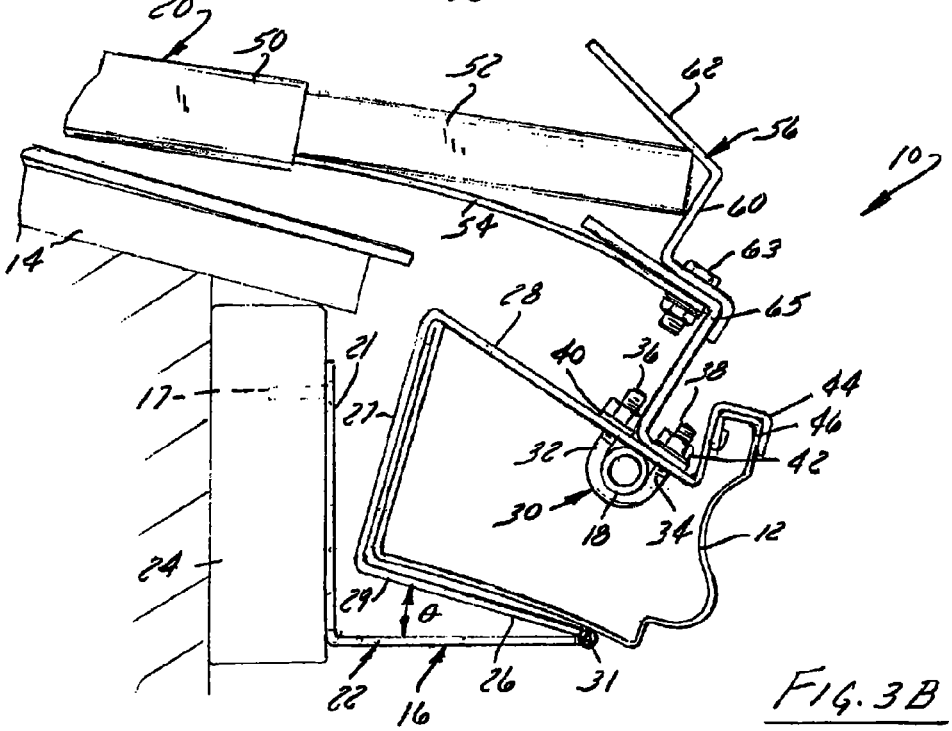
FIG. 3B is an end elevation view of the gutter dumping assembly of FIGS. 1-3A in a rotated, over-center position.

Turning now to FIGS. 3A and 3B, and initially to FIG. 3A, the gutter dumping assembly 10 of the present invention is shown just prior to actuation thereof Accordingly, inner tube 52 and flexible strap 54 are shown in substantially non-extended positions. Referring now to FIG. 3B, the gutter dumping assembly is shown at a position just before reaching an over-center position wherein the gutter dumping assembly 10 and gutter 12 freely fall to a dumped position under the force of gravity. As shown in FIG. 3B, inner tube 52 and flexible strap 54 of actuator assembly 20 are shown partially extended from outer tube 50. The driving of the inner tube 52 from the outer tube 50 causes the strap 54 to flex, and the inner tube 52 continues to move outwardly until it engages the vertical leg 60 of kicker bracket 56. Continued motion of the inner tube 52 forces the kicker bracket 56 forward. The driving of the kicker bracket 56 serves to likewise drive the C-bracket 26 of bracket assembly 16 to pivot or otherwise hinge about a horizontal axis. As such, the gutter, which is retained by C-bracket 26, is likewise rotated about a horizontal axis.

The driving of the actuator assembly 20 causes the bracket assembly 16 to pivot the gutter 12 about an angle, Θ, wherein the assembly and gutter reaches an over-center position. Preferably Θ is about fifteen degrees. Once reaching the over-center position, the gutter 12 is free to fully rotate to a downwardly-facing position wherein the contents therein may be dumped or more easily manually removed by an operator. The rate at which the gutter 12 falls is controlled by the flexible strap 54 to the rate of extension of the inner tube 52.

Further, if the gutter 12 engages an obstruction such as a downspout during rotation, it simply rests against the obstruction. Further extension of the inner tube 52 simply results in imposing slack in the flexible strap 54. This is particularly advantageous over other actuators for gutter dumping systems that positively drive the gutter to its dump position.

Figure 5:
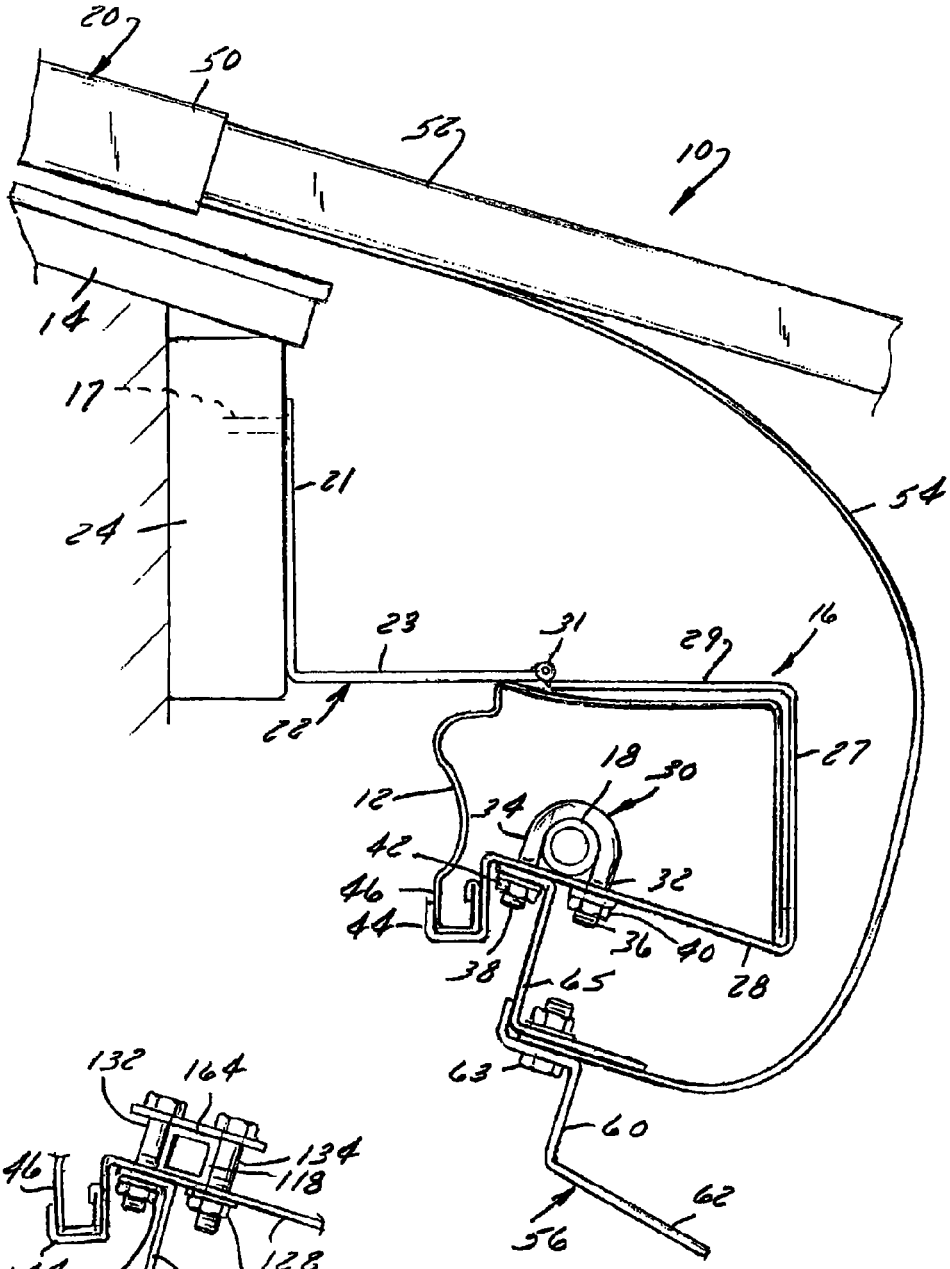
FIG. 5 is an end elevation view of the gutter dumping assembly of FIGS. 1-4 in the downwardly-facing dumped position.

Turning now to FIGS. 4 and 5, and initially to FIG. 4, gutter dumping assembly 10 is shown having rotated the gutter 12 and C-bracket 26 to the over-center position wherein the assembly 10 and gutter 12 freely fall to a dumped position under gravitation force. The downwardly-facing dumped position is shown in shadow in FIG. 4 wherein the gutter 12 is facing directly down at the ground. FIG. 5 shows the gutter 12 and gutter dumping assembly 10 of FIG. 4 in the downwardly-facing dumped position.

The gutter 12 can be returned to its upright position simply by reversing the direction of the motor 51 of actuator assembly 20 to retract the inner tube of the actuator assembly 20 into the outer tube 50, hence causing the strap 54 to retract and pivot the c-bracket 26 counterclockwise about hinge 31 until the gutter 12 returns to its normal position of FIGS. 1 and 2A. In addition, the gutter 12 may be kept in the downwardly-facing dumped position during the winter months in colder climates to prevent the build-up of ice dams.

Figure 6:
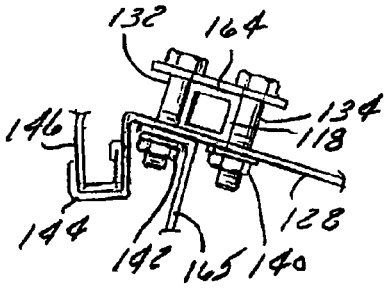
FIG. 6 is an end elevation view of a portion of the gutter dumping assembly of a second embodiment.

Referring now to FIG. 6, an alternative embodiment of the present invention includes a support member 118 having a generally rectangular cross-section. Support member 118 is retained by a pair of threaded bolts 132 and 134. Bolts 132 and 134 are inserted through a pair of holes in upper leg 128 as in the prior embodiment. A pair of nuts 140 and 142 or similar such fasteners are provided to secure the bolts 132 and 134 in the holes in upper leg 128. Support member 118 is restrained from lateral movement by bolts 132 and 134. Upper leg 128 prevents support member 118 from slipping upwardly (when at rest) or downwardly (when in dumped position). In addition, a retaining bar 164 is provided for supporting the support member 118 when the gutter dumping assembly 10 is in the initial, upright position. Retaining bar 164 preferably includes a pair of holes for receiving the threaded ends of bolts 132 and 134. The alternative embodiment of the present invention is advantageous in that support member 118 is not capable of being overtightened by twisting thereof. Accordingly, support member 118 is not crimped or otherwise damaged during installation.

Although the best mode contemplated by the inventors of carrying out the present invention is disclosed above, practice of the present invention is not limited thereto. It will be manifest that various additions, modifications and rearrangements of the aspects and features of the present invention may be made in addition to those described above without deviating from the spirit and scope of the underlying inventive concept. The scope of some of these changes is discussed above. The scope of other changes to the described embodiments that fall within the present invention but that are not specifically discussed above will become apparent from the appended claims and other attachments.

We claim:

1. A dumping assembly for a gutter comprising:

at least one bracket assembly configured to receive and retain the gutter and to be mounted to a building;

an actuator assembly mounted to the building and configured to operably, engage the at least one bracket assembly to thereby rotate the bracket assembly and the gutter from an upright position to an over-center position such that the gutter falls to a dumped position under gravitational force; and an motor mounted on top of a roof of the building at a location that is disposed inwardly of an outer edge of the roof, the motor being configured to selectively drive the actuator assembly to move the gutter between the upright position and the dumped position.

2. The dumping assembly of claim 1, wherein the bracket assembly includes a first, stationary bracket that is supported on the building and a second bracket that supports the gutter and that is pivotally connected to the first bracket.

3. The dumping assembly of claim 2, wherein the at least one bracket assembly comprises a plurality of bracket assemblies coupled to one another by a support member positioned within and extending in parallel with the gutter.

4. The dumping assembly of claim 2, wherein the actuator assembly is configured to operably engage the second bracket to move the second bracket from an upright position to a dumped position.

5. The dumping assembly of claim 4, wherein the second bracket includes:

a. an upper leg having an inner end and an outer end, the outer end angled downwardly;

b. a lower leg coupled to tile upper leg; and c. a retainer disposed on the outer end of the upper leg and configured to receive and retain the gutter.

6. The dumping assembly of claim 5, wherein the actuator assembly comprises:

a. an actuator bar;

b. a strap coupled to the actuator bar and extendible therefrom; and c. a kicker bracket coupled to the strap and the second bracket;

wherein driving of the actuator bar causes the strap to extend therefrom and causes the kicker bracket to rotate along with the second bracket and gutter.

7. The dumping assembly of claim 6, wherein the actuator comprises an outer tube and an inner tube telescopically disposed in the outer tube and coupled to the strap.

8. A gutter system comprising:

a gutter that defines a pair of opposed sides, a pair of ends, a bottom and an upwardly open top;

a gutter dumping assembly coupled to the gutter, the gutter dumping assembly comprising, (a) a support member;

(b) a plurality of bracket assemblies coupled to the support member and supporting the gutter; and (c) an actuator assembly configured to operably engage at least one of the bracket assemblies to rotate the bracket assemblies, the gutter, and a frame with respect to a building to an over-center position;

(d) an motor mounted on top of a roof of the building at a location that is disposed inwardly of an outer edge of the roof, the motor being configured to selectively drive the actuator assembly to move the gutter between the upright position and the dumped position;

wherein, upon reaching the over-center position, the bracket assemblies, the gutter, and the frame fall to a dumped position under gravitational force.

9. The gutter system of claim 8, wherein the actuator assembly comprises:

a base;

a strap coupled to the base and extendible therefrom; and a kicker bracket coupled to the strap and the bracket assembly, wherein extension of the strap from the base causes the kicker bracket to rotate along with the second bracket and the gutter.

10. The gutter system of claim 9, wherein the base comprises an outer tube and an inner tube telescopically housed in the outer tube, and wherein the strap is coupled to the inner tube thereof.

11. The gutter system of claim 10, wherein the kicker bracket includes a vertical leg and a forwardly extending horizontal leg coupled to the vertical leg, and wherein the vertical leg acts as an abutment surface for engagement with the inner tube and the forwardly extending horizontal leg is operably coupled to the strap.

12. The gutter system of claim 9, wherein the kicker bracket further includes a rearwardly extending horizontal leg coupled to the vertical leg, wherein the rearwardly extending horizontal leg prevents the actuator assembly from pivoting upwardly and out of contact with the kicker bracket during driving of the actuator assembly.

13. A method of dumping a gutter attached to a building to clear debris collected therein, the gutter being coupled to a gutter dumping assembly having a roof-mounted actuator assembly, the method comprising the step of:

driving the actuator assembly, via operation of an motor, to operably engage a bracket assembly of the gutter dumping assembly such that the bracket assembly rotates the gutter to an over-center position and the gutter thereafter rotates to a dumped position under gravitational force, the motor being mounted on top of a roof of a building at a location that is disposed inwardly of an outer edge the roof.

14. The method of claim 13, further comprising, after the driving step, retracting the actuator assembly via operation of the motor such that the bracket assembly rotates the gutter from the dumped position to an upright position.

15. The method of claim 13, wherein movement of the gutter to the dumped position occurs at a rate controlled by a rate of actuator movement.

* * * * *